US006611978B1

(12) United States Patent
Schmidt et al.

(10) Patent No.: US 6,611,978 B1
(45) Date of Patent: Sep. 2, 2003

(54) PATIENT-SUPPORT APPARATUS

(75) Inventors: Rick A. Schmidt, Orlando, FL (US); David C. Newkirk, Lawrenceburg, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/713,105

(22) Filed: Nov. 15, 2000

Related U.S. Application Data

(60) Provisional application No. 60/165,623, filed on Nov. 15, 1999.

(51) Int. Cl.[7] ..... A61G 11/00

(52) U.S. Cl. ..... 5/603; 5/655; 5/610; 600/22

(58) Field of Search ..... 5/610, 603, 655; 600/22

(56) References Cited

U.S. PATENT DOCUMENTS

| | | | | |
|---|---|---|---|---|
| 793,168 | A | * 6/1905 | Abrams | 5/411 |
| 1,787,805 | A | 1/1931 | Walter | |
| 1,914,288 | A | 6/1933 | Poll, Sr. | |
| 2,187,312 | A | 1/1940 | Goodlake | |
| 3,069,700 | A | 12/1962 | Berlin | |
| 3,158,150 | A | 11/1964 | Croasdaile | |

(List continued on next page.)

FOREIGN PATENT DOCUMENTS

| | | |
|---|---|---|
| DE | 20 61 704 | 6/1971 |
| DE | 36 07 575 | 9/1987 |
| EP | 0 236 851 | 9/1987 |
| EP | 0 974 328 | 6/2000 |
| FR | 2 031 559 | 11/1970 |
| GB | 1161817 | 8/1969 |
| GB | 1232048 | 5/1971 |
| GB | 2 067 077 | 7/1981 |
| GB | 2 175 213 | 11/1988 |
| JP | 49-122184 | 11/1974 |
| JP | 5-103817 | 4/1993 |
| WO | WO 83/01189 | 4/1983 |
| WO | WO 90/09771 | 9/1990 |
| WO | WO 97/11664 | 4/1997 |

OTHER PUBLICATIONS

Musch, Adams and Sunshine, *Journal of Pediatrics,* "Air Curtain Incubator for use in Intensive–Care Nursery," vol. 79, No. 6, pps. 1024–1030.

"Infa–Care 2000," Infa–Care, Inc. Product Brochure, six pages, 1972.

"Stabilet® From Hill–Rom®" Product Brochure, six pages, 1992.

"Stabilet CC™ From Hill–Rom®" Product Brochure, six pages, 1992.

"The Stabilet™ Freestanding Warmer and Clinical Bassinet From Hill–Rom®" Product Brochure, four pages, 1993.

"'A Hill–Rom Solution; ' Stabilet 2000C, Stabilet CC; Stabilet Freestanding Infant Warmer Accessories" Product Brochure, eight pages, 1995.

"ISOLETTE® (Infant Incubator . . . The Essence of Incubation," Air–Shields, Inc. Product Brochure, eight pages, 1996.

"The New Isolette® Infant Incubator Only from Air–Shields" Product Brochure, one page, Sep. 1996.

*Primary Examiner*—Michael F. Trettel
(74) *Attorney, Agent, or Firm*—Barnes & Thornburg

(57) ABSTRACT

A patient support apparatus comprises a frame and a deck that is laterally movable relative to the frame between a central position and extended positions away from the central position. The patient support apparatus may further include a mounting mechanism that is configured to secure the deck to the frame. The mounting mechanism allows lateral movement relative to the frame to the extended positions away from the central position.

31 Claims, 10 Drawing Sheets

U.S. PATENT DOCUMENTS 3,187,744 A 6/1965 Dorsak et al.
3,335,713 A * 8/1967 Grosholz et al. ..... 600/22
3,387,600 A 6/1968 Teirian
3,511,152 A 5/1970 Truhan
3,618,734 A 11/1971 Khan
3,776,217 A 12/1973 van Galen et al.
3,782,362 A 1/1974 Puzio
3,821,947 A 7/1974 Schossow
3,858,570 A 1/1975 Beld et al.
4,063,495 A 12/1977 Duvlis
4,140,105 A 2/1979 Duvlis
4,161,172 A 7/1979 Pickering
4,186,456 A 2/1980 Huempfner
4,222,602 A 9/1980 Kouth
4,321,913 A 3/1982 Maluta et al.
4,361,137 A 11/1982 Grosholz
4,423,669 A 1/1984 Bullock et al.
4,552,034 A 11/1985 Bertani et al.
4,617,912 A 10/1986 Beer et al.
4,628,553 A 12/1986 Buttitta et al.
4,641,385 A 2/1987 Peters et al.
4,734,945 A 4/1988 Wright
4,750,474 A 6/1988 Dukhan et al.
4,773,392 A 9/1988 Koch
4,796,605 A 1/1989 Sasaki et al.
4,809,677 A 3/1989 Mackin et al.
4,819,282 A 4/1989 McArthur et al.
4,846,783 A 7/1989 Koch et al.
4,885,918 A 12/1989 Vaccaro
4,934,007 A 6/1990 Sweet
4,936,824 A 6/1990 Koch et al.
5,112,293 A 5/1992 Vaccaro
5,119,467 A 6/1992 Barsky et al.
5,162,038 A 11/1992 Wilker
5,224,923 A 7/1993 Moffett et al.
5,242,375 A 9/1993 McDonough
5,244,452 A * 9/1993 Vaccaro et al. ..... 5/603
5,285,054 A 2/1994 Barsky
5,285,519 A 2/1994 Barsky et al.
5,308,310 A 5/1994 Roff et al.
5,316,542 A 5/1994 Koch et al.
5,330,415 A 7/1994 Storti et al.
5,336,156 A 8/1994 Miller et al.
5,339,223 A 8/1994 Kremenchugsky et al.
5,352,869 A 10/1994 Barsky
5,376,761 A 12/1994 Koch et al.
5,400,425 A 3/1995 Nicholas et al.
5,446,934 A 9/1995 Frazier
5,453,077 A 9/1995 Donnelly et al.
5,474,517 A 12/1995 Falk et al.
5,498,229 A 3/1996 Barsky et al.
5,531,663 A 7/1996 Gloyd et al.
5,539,854 A 7/1996 Jones et al.
D375,792 S 11/1996 Hillman et al.
5,616,115 A 4/1997 Gloyd et al.
5,624,375 A 4/1997 Dykes et al.
5,649,896 A 7/1997 Barsky
5,759,149 A 6/1998 Goldberg et al.
5,800,335 A 9/1998 Koch et al.
5,817,002 A 10/1998 Donnelly et al.
5,817,003 A 10/1998 Moll et al.
5,830,123 A 11/1998 Franz et al.
5,876,323 A 3/1999 Hodge et al.
5,971,913 A 10/1999 Newkirk et al.
5,971,914 A 10/1999 Donnelly et al.
6,022,310 A 2/2000 Goldberg et al.
6,024,694 A 2/2000 Goldberg et al.
6,036,634 A 3/2000 Goldberg et al.
6,049,924 A 4/2000 Prows et al.
6,071,228 A 6/2000 Speraw et al.

* cited by examiner

PATIENT-SUPPORT APPARATUS

RELATED APPLICATION

The present disclosure is based upon United States Provisional Patent Application Serial No. 60/165,623, filed Nov. 15, 1999, the complete disclosure of which is hereby expressly incorporated by reference.

TECHNICAL FIELD

The present invention relates to patient-support apparatus for use as infant-care units of the type having a movable infant support.

BACKGROUND AND SUMMARY

Infant care units, such as an infant incubator or warmer that includes various systems for controlling the temperature and humidity to facilitate the development of a premature infant, are known. Such incubators conventionally include an infant-support surface for supporting the infant and some type of overhead structure, such as a canopy, above the infant-support surface. In some cases, an isolation chamber is formed by a set of panels arranged around the infant-support surface. The canopy cooperates with these panels to enclose the isolation chamber. Access openings through which care givers gain access to the infant are provided in either the canopy or in the panels. Such units may also include canopies that have access doors to provide further access to the infant.

Conventionally, such incubators include an infant-support surface or deck that is movable relative to the incubator for moving the infant to a desirable position for treatment. For example, the deck can be moved to Trendelenberg or reverse-Trendelenberg tilted positions. To accommodate this movement, the deck is often suspended above a tub or frame having a cavity disposed therein. When moved to one of these positions, a portion of the deck extends into the cavity. Accordingly, the cavity should be sized to provide sufficient space to allow these broad range of tilted positions. The cavity is also useful for providing empty space for receiving scales and x-ray cassette trays which are often positioned below the deck.

It would, therefore, be beneficial to provide convenient access to the cavity. Such access would be useful for maintenance of the apparatus, cleaning the cavity, and retrieving instruments that have dropped into the cavity during care of the infant.

Accordingly, one illustrative embodiment provides a patient-support apparatus comprising a frame and a deck that is laterally movable relative to the frame between a central position and extended positions away from the central position. The illustrative embodiment may further include a mounting mechanism. The mounting mechanism is configured to secure the deck to the frame. The mechanism also allows lateral movement relative to the frame to the extended positions away from the central position. The apparatus may also include first and second slide assemblies, first and second bearing surfaces, rails, a projecting pin and a pin-receiving aperture, a weldment, a scale, and an x-ray cassette. Furthermore, the first and second slide assemblies are movable in a direction substantially perpendicular to the lateral movement of the deck to form a Trendelenberg tilt position. In further embodiments, the deck is a mattress.

Another illustrative embodiment provides an infant-support apparatus having a deck which is movable between a central position and a position spaced therefrom in a plane parallel to a plane defined by the apparatus. The apparatus may include a cavity wherein the deck substantially occludes the cavity when the deck is in the central position. The deck also exposes the cavity when the deck is in the position spaced from the central position.

Another illustrative embodiment provides an infant-support apparatus comprising a base and a support configured to receive an infant. The support is movable upwardly and downwardly on the base and is movable laterally between a central position and a position spaced therefrom. Side guards are provided which are associated with the support. The side guards are also movable between upright and lowered positions and are configured to provide access to the infant. An assembly is provided comprising a canopy and a radiant warmer. The assembly is movable upwardly and downwardly relative to the support between upper and lower positions. When the assembly is in the lower position, the canopy cooperates with the side guards, in the upright position, to form an incubator enclosure configured to receive the infant. When the assembly is in the upper position, the radiant warmer provides warmth to the infant. Further illustrative embodiments include a humidifier for providing moist air to the enclosure. An x-ray tray under the support surface, and one or more weight scales may also be provided.

Additional features and advantages of the apparatus will become apparent to those skilled in the art upon consideration of the following detailed descriptions exemplifying the best mode of carrying out the apparatus as presently perceived.

BRIEF DESCRIPTION OF THE DRAWINGS

The illustrative apparatus will be described hereinafter with reference to the attached drawings, which are given as non-limiting examples only, in which.

Corresponding reference characters indicate corresponding parts throughout the several views. The exemplification set out herein illustrates several embodiments of the apparatus, and such exemplification is not to be construed as limiting the scope of the apparatus in any manner.

DETAILED DESCRIPTION OF THE DRAWINGS

Figure 10:
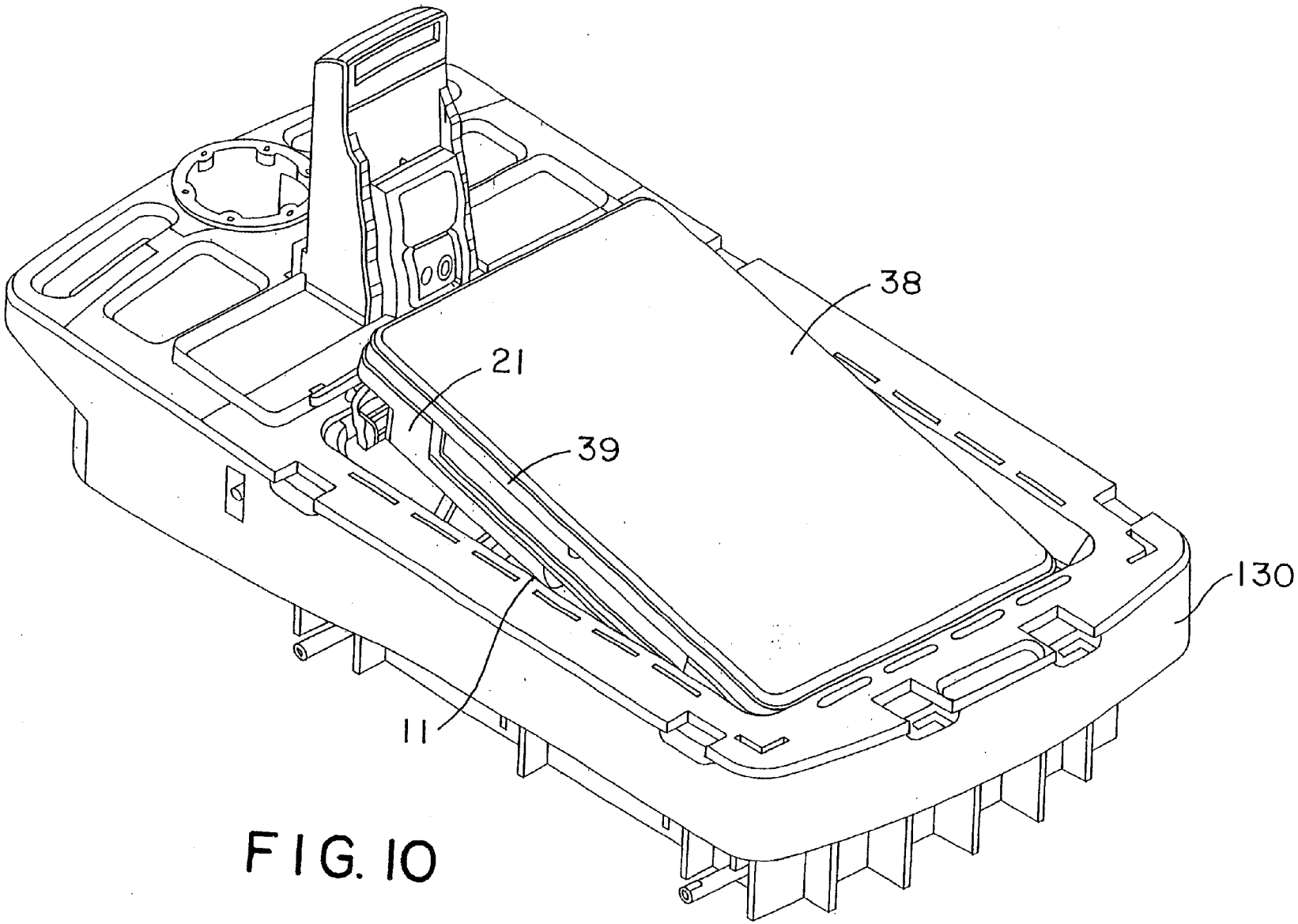
FIG. 10 is a left-hand perspective view of a portion of the patient-support apparatus of FIG. 1.

According to the illustrated embodiment, the thermal support apparatus 120 includes a deck 21 or associated structure upon which an infant is supported. Deck 21 is movable laterally with respect to apparatus 120. For example, deck 21 is movable between a central position and any laterally extended position (e.g., compare FIG. 10 to FIG. 11). Such laterally extended positions exist in substantially the same plane as the central position or apparatus 120 itself. It is contemplated that the laterally extended position exists in any direction that is spaced apart from the central position, as shown in FIG. 10, and is not limited to the illustrated extended position, which is shown for illustrative purposes only.

Figure 1:
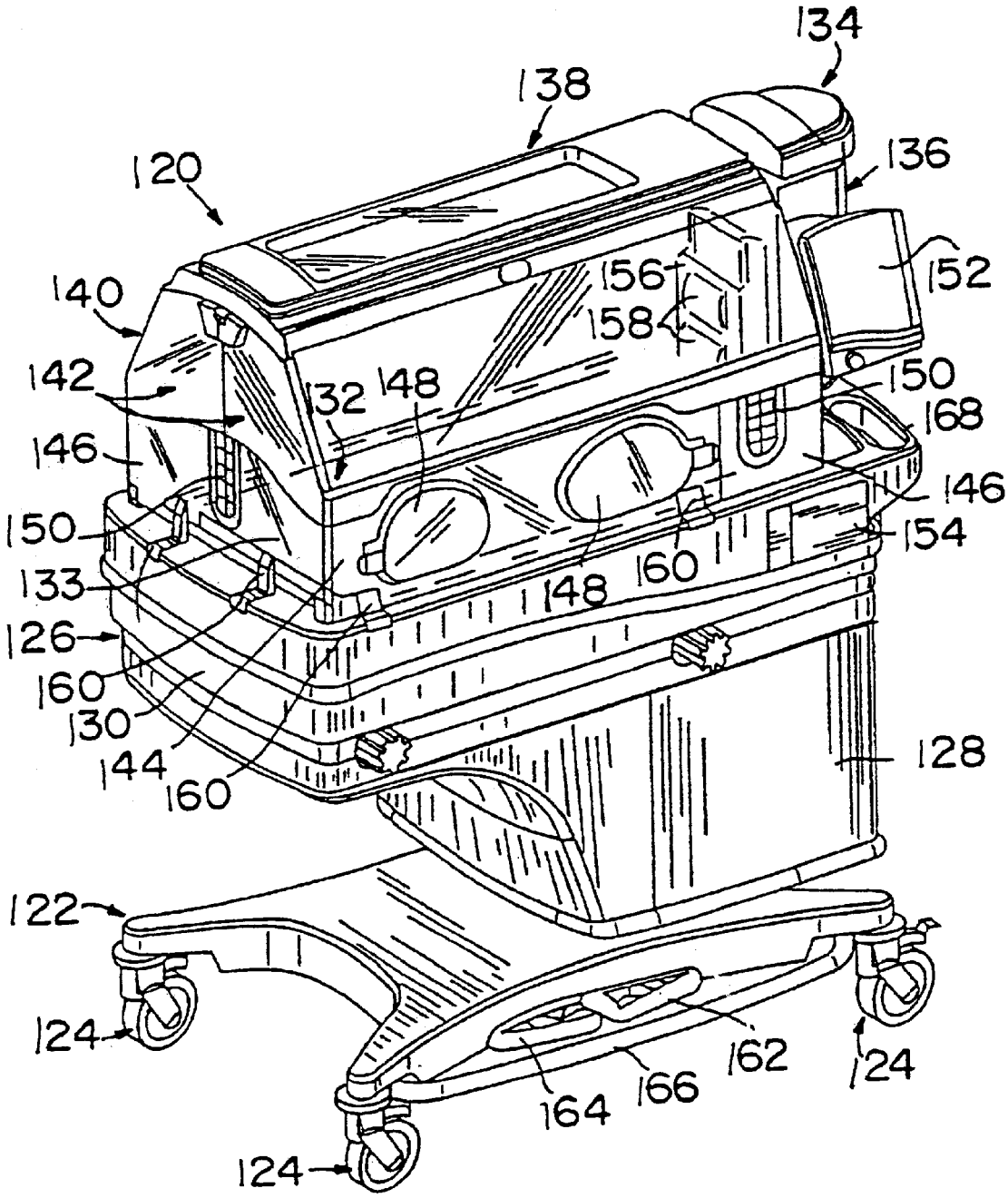
FIG. 1 is a perspective view of a patient-support apparatus.

The thermal support apparatus or patient-support apparatus 120, such as an infant warming device or incubator, includes a base 122, a plurality of castors 124 extending downwardly from base 122, and an infant supporting portion or patient-support 126 supported above base 122, as shown in FIG. 1. Patient-support 126 includes a pedestal 128 coupled to base 122 for vertical movement, a platform tub 130 supported by pedestal 128, and a mattress 132 supported above platform tub 130. Mattress 132 has an upwardly facing patient-support surface 133. Patient-support apparatus 120 also includes a canopy support arm 134 including a telescoping vertical arm 136, and a horizontal overhead arm 138. A canopy 140 is coupled to overhead arm 138, and is positioned to lie above platform tub 130. Canopy 140 includes a pair of canopy halves 142 coupled to overhead arm 138 for pivoting movement between a lowered position, shown, for example, in FIGS. 1 and 3, and a raised position, shown in FIG. 4.

A pair of transparent side guard panels 144 and a pair of transparent end guard panels 146 extend upwardly from platform tub 130, as shown in FIG. 1. Side guard 125 panels 144 and end guard panels 146 cooperate with canopy halves 142 and overhead arm 138 to provide patient-support apparatus 120 with an isolation chamber. Side guard panels 144 may be formed to include a pair of access ports that are normally closed by access port covers 148. Access port covers 148 can be opened to allow access to a patient, such as an infant, supported by patient-support apparatus 120 within the isolation chamber. Each end 130 guard panel 146 is formed to include at least one U-shaped window, and a pass-through grommet 150 is positioned to lie in each U-shaped window. Wires and tubes (not shown) can be routed into the isolation chamber through pass-through grommets 150.

Patient-support apparatus 120 includes a user interface panel 152 for monitoring various systems that control the temperature and humidity of the isolation chamber, and for allowing care givers to input various control parameters into memory of a control system of patient-support apparatus 120. Patient-support apparatus 120 also includes a humidifier module 154 that can be filled with water and inserted into a humidifier compartment of platform tub 130. Heated air is blown through humidifier module 154 and directed into the isolation chamber. A tower 156 is positioned to lie in the isolation chamber. Tower 156 supports various sensors 158, such as patient environmental sensors and light and noise sensors, and also provides a return-air path for the air being circulated through the isolation chamber.

Hinges 160 are provided so that side guard panels 144 and one of end guard panels 146 can pivot downwardly away from canopy 140 to provide increased access to the infant supported by patient-support apparatus 120. Up and down buttons (not shown) can be pressed to extend and retract vertical arm 136 of canopy support arm 134, thereby raising and lowering, respectively, overhead arm 138 and canopy 140. Patient-support apparatus 120 includes an up pedal 162 that can be depressed to raise patient-support 126 relative to base 122 and a down pedal 164 that can be depressed to lower patient-support 126 relative to base 122 and a down pedal 164 that can be depressed to lower patient-support 126 relative to base 122. Patient-support apparatus 120 includes a side bumper 166 that protects pedals 162, 164 and other components, such as base 122 and pedestal 128, from inadvertent impact. Platform tub 130 is formed to include a handle 168 on each side of canopy support arm 134. Handles 168 can be grasped by a care giver to maneuver patient-support apparatus 120 during transport.

Figure 2:
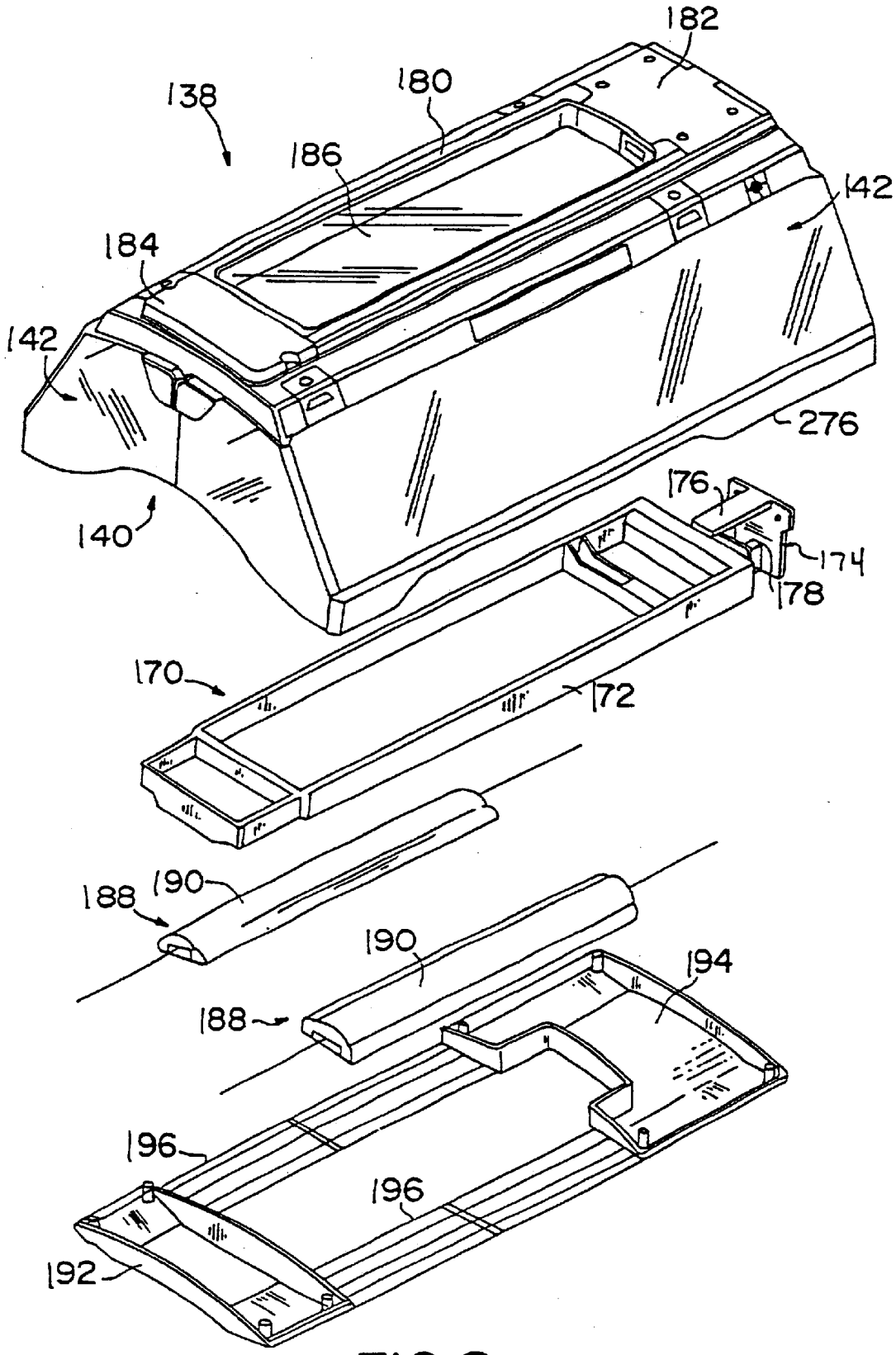
FIG. 2 is an exploded view of a portion of the canopy support arm of the apparatus of FIG. 1.

Overhead arm 138 includes an overhead arm structural member 170 having a substantially rectangular frame member 172 and an end plate 174 coupled to frame member 172 by a horizontal flange 176 and a vertical flange 178, as shown in FIG. 2. Overhead arm structural member 170 is the component of overhead arm 138 that supports the other components of overhead arm 138. For example, overhead arm 138 includes a top cover 180 that overlies structural member 170 and is attached thereto. Canopy halves 142 are attached to top cover 180 for pivoting movement. In addition, overhead arm 138 includes a circuit board cover 182 that covers an electrical circuit (not shown) situated in a rear compartment formed in top cover 180, and an alarm light cover 184 that covers a set of alarm lights (not shown) situated in a front compartment formed in top cover 180. Overhead arm 138 includes an elongated x-ray window 186 received in a central aperture formed in top cover 180.

A pair of infrared heater assemblies 188 are coupled to overheard arm 138 below overhead arm structural member 170. Infrared heater assemblies 188 provide warmth to the patient supported on patient-support surface 133. Infrared heater assemblies 188 extend longitudinally and are laterally spaced apart from one another as shown in FIG. 2. Each infrared heater assembly 188 includes a deflector 190 to direct the heat towards patient-support 126. Overhead arm 138 includes a front bottom cover 192 and a rear bottom cover 194, each of which couple to top cover 180. A pair of heater grills 196 are connected to and extend longitudinally between front and rear bottom covers 192, 194 beneath infrared heater assemblies 188.

Infrared heater assemblies 199 can be actuated to adjust the temperature of the environment in the isolation chamber where the patient resides. By providing patient-support apparatus 120 with two infrared heater assemblies 188, the IR frequency required to achieve a specific temperature at patient-support surface 133 is higher than if only one infrared heater is provided. In addition, providing patient-support device with two infrared heater assemblies 188 results in the heat energy being distributed over patient-support surface 133 more uniformly than if only one infrared heater were provided.

The canopy halves 142, side guard panels 144, and end guard panels 146 help to distribute the infrared energy from infrared heater assemblies 188 evenly throughout the isolation chamber. By properly aligning canopy 140 with side and end guard panels 144, 146, infrared heat losses are minimized. Patient-support apparatus 120 includes a third heater (not shown) which heats air that is circulated beneath canopy 140 by an air circulation system (not shown) of the patient-support apparatus 120. Humidifier module 154 also includes a heater to heat the water contained therein so that, as the heated air is circulated through humidifier module 154, the air is humidified. The heated air is directed upwardly adjacent to the side and end panels 144, 146, and is deflected by canopy 140 over patient-support surface 133. By properly aligning canopy 140 with side and end guard panels 144, 146, convective heat losses and air losses are minimized.

Figure 3:
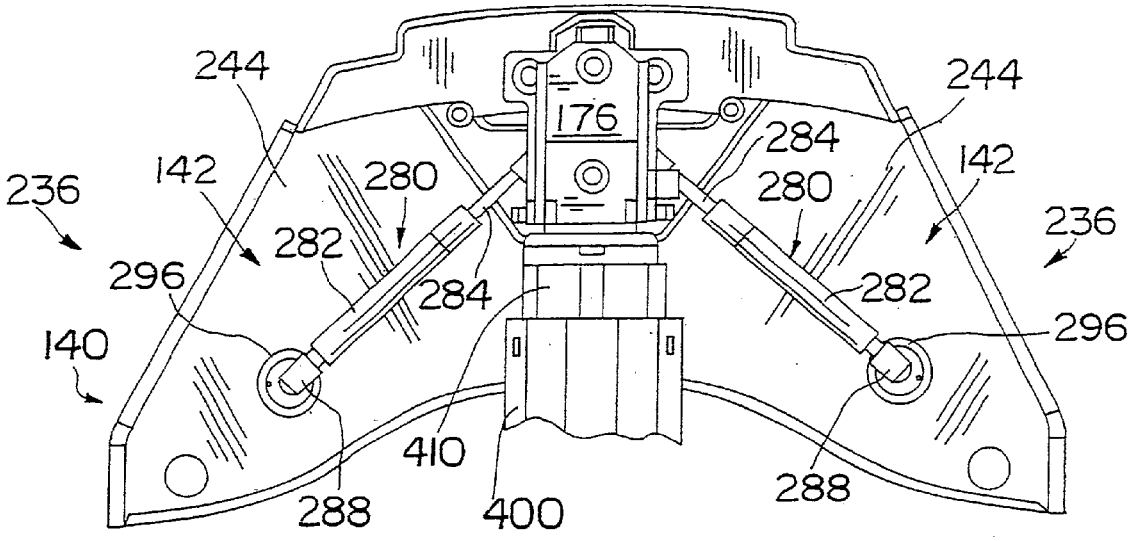
FIG. 3 is an end elevation view of an attachment mechanism, overhead arm and canopy halves from the apparatus of FIG. 1 showing the canopy halves held in a lowered position.
Figure 4:
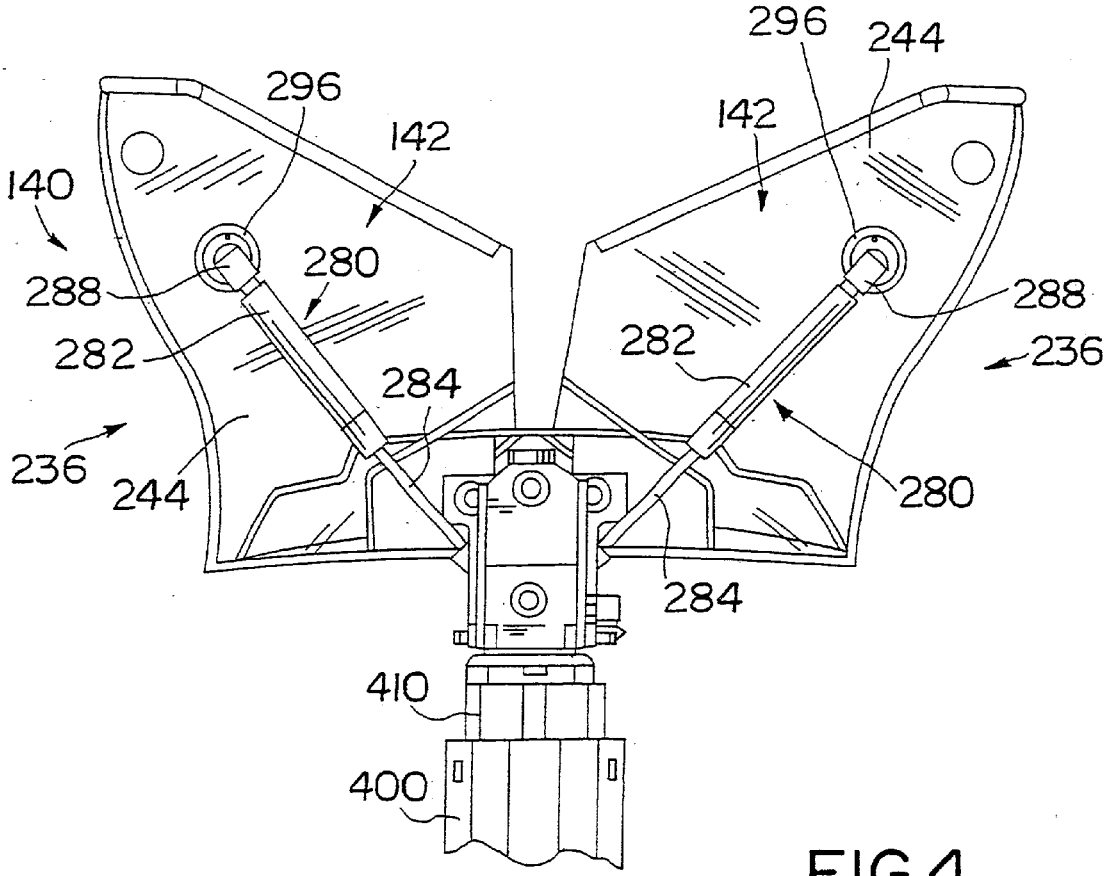
FIG. 4 is an end elevation view similar to FIG. 3 showing the canopy halves held in a raised position.

A gas spring dashpot 280 couples each canopy half 142 to overhead arm 138, as shown in FIGS. 3 and 4. When canopy halves 142 are in the lowered position, gas spring dashpots 280 are in a retracted position, shown in FIG. 3, and when canopy halves 142 are in the raised position, gas spring dashpots 280 are in an extended position, shown in FIG. 3. Gas spring dashpots 280 operate to hold canopy halves 142 in the respective raised and lowered positions, and to restrict inadvertent movement of canopy halves 142 relative to overhead arm 138 while in the raised and lowered positions.

Each gas spring dashpot 280 includes a cylindrical housing 282 and a piston rod 284 coupled to housing 282 for sliding movement. A mounting head (not shown)is coupled to the outer end of each piston rod 284 and a mounting head 288 is coupled to each housing 282.

A mounting plug 296 is mounted to each rear portion 244 of transparent shields 236, as shown in FIGS. 3 and 4. Each mounting plug 296 is formed to include an aperture (not shown). Mounting head 288 of each gas spring dashpot 280 includes a forwardly extending post (not shown), that is received in a respective aperture formed in each mounting plug 296.

Canopy support arm 134 includes vertical arm 136 and overhead arm 138 as previously described. Vertical arm 136 includes an outer tubular column 400, an inner tubular column 410, and a telescoping drive assembly (not shown). (See FIGS. 3 and 4.) Inner column 410 telescopically extends and retracts relative to outer column 400 in response to actuation of the drive assembly to raise and lower canopy halves 142.

Other features of the patient-support apparatus 120 are discussed in detail in, and may be constructed and operated in accordance with, those apparatus shown and described in U.S. Pat. No. 6,071,228, entitled PATIENT-SUPPORT ASSEMBLY FOR THERMAL SUPPORT APPARATUS, the disclosure of which is hereby incorporated by reference. Other features of the patient-support apparatus are discussed in detail in U.S. Pat. No. 6,022,310, entitled CANOPY ADJUSTMENT MECHANISMS FOR THERMAL SUPPORT APPARATUS; U.S. Pat. No. 6,049,924, entitled HINGED PANELS FOR A THERMAL SUPPORT APPARATUS; and U.S. Pat. No. 6,024,694, entitled HUMIDIFIER FOR A THERMAL SUPPORT APPARATUS, each of which is also incorporated herein by reference.

Figure 5:
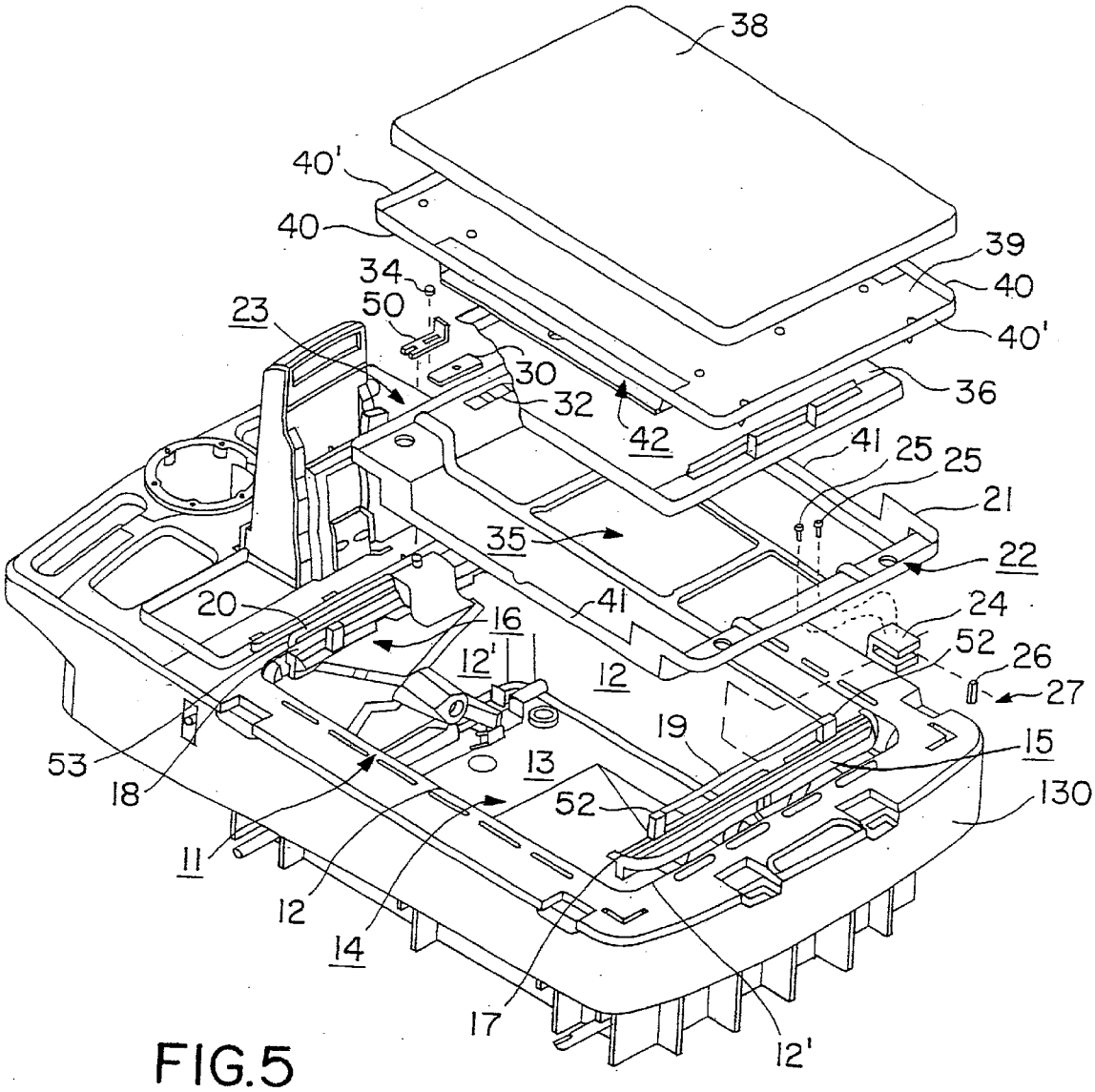
FIG. 5 is an exploded perspective view of a portion of the patient-support apparatus of FIG. 1.

As shown in FIG. 5, tub 130 comprises a frame 11 defined by spaced side and end walls 12, 12' appending from bottom 13 to form a cavity 14. Attached at opposite ends of bottom 13 are first and second mounting mechanisms 15, 16. First and second mounting mechanisms 15, 16 are configured to couple deck 21 to tub 130, suspending deck 21 at a central position over cavity 14. First and second rail supports 17, 18 are attached to first and second mounting mechanisms 15, 16, respectively. First and second rails 19, 20 are attached to first and second rail supports 17, 18, respectively. These supports and rails allow deck 21 and/or mattress pad 38 to move with respect to frame 11, as described further herein.

It is appreciated that any variety of structures that can move mattress pad 38 relative to frame 11 may be used in place of rail supports 17, 18 and rails 19, 20. For example, a tilting, pivoting, or swinging mechanism can be used to move pad 38 relative to frame 11.

Figure 6:
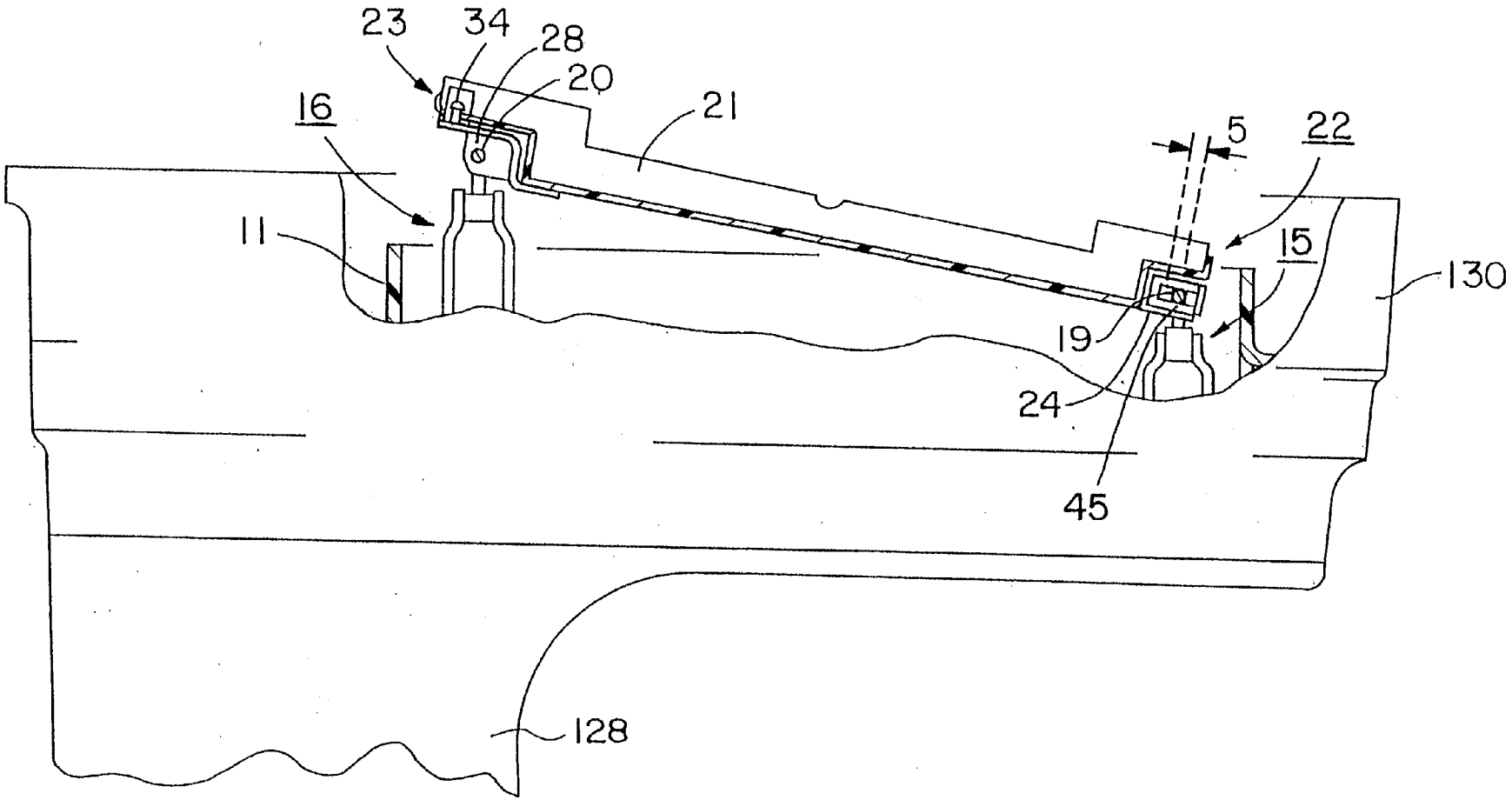
FIG. 6 is a side elevation partial cutaway view of the patient-support apparatus of FIG. 1.
Figure 11:
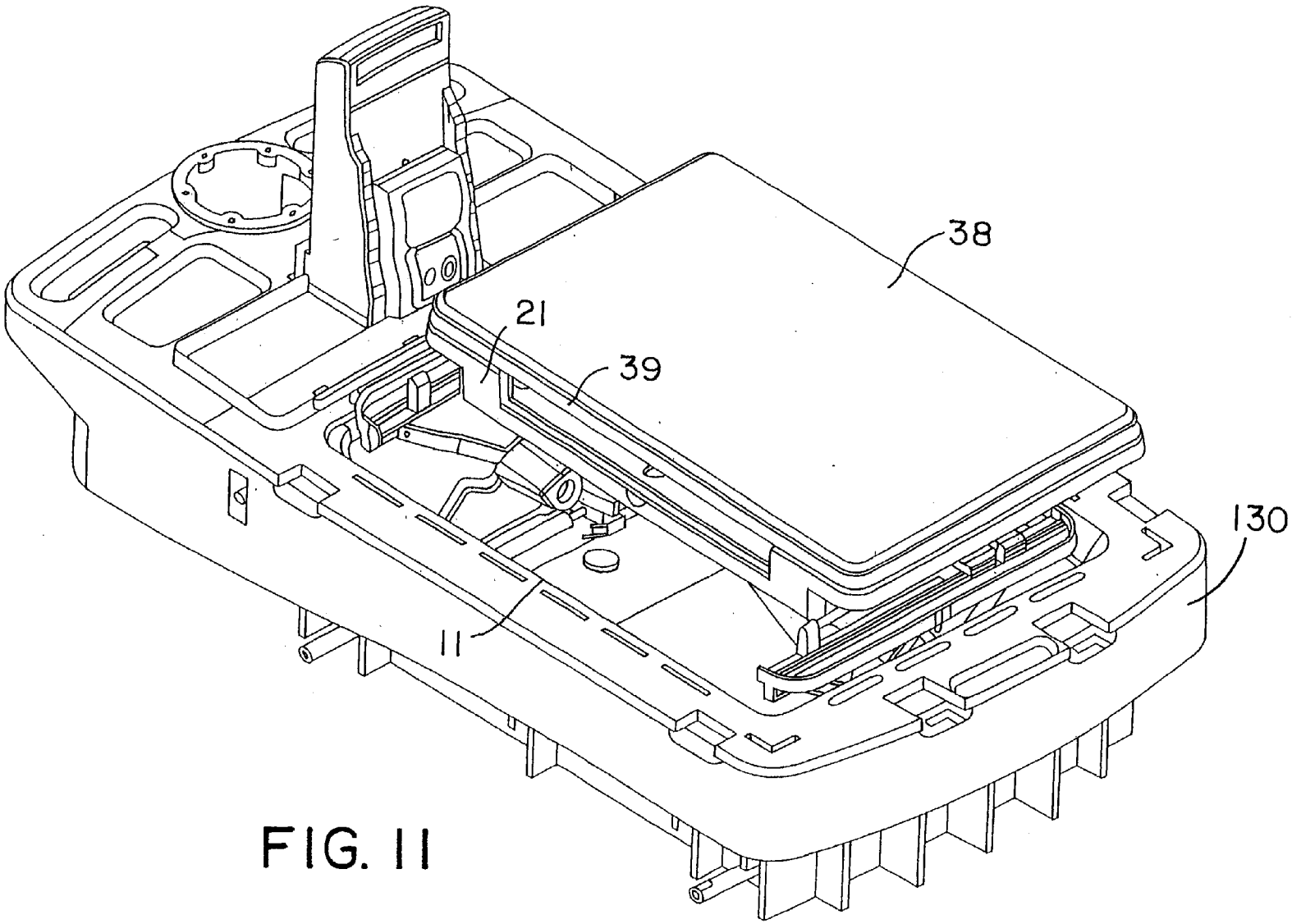
FIG. 11 is another left-hand perspective view of a portion of the patient-support apparatus of FIG. 1.

Deck 21 is oriented in a central position relative to frame 11, as shown in FIG. 10. Deck 21 is movable between an extended position and the central position, as shown in FIG. 11. It is appreciated, however, that deck 21 can be configured to move between any positions within the same general plane as the central position. Deck 21 has longitudinally spaced apart first and second ends 22, 23, as shown in FIGS. 5 and 6. A slide bracket 24 attached to first end 22 by mechanical fasteners 25 movably engages the longitudinal axis of first rail 19. In one embodiment, slide bracket 24 may be attached to mattress pad 38 in place of deck 21.

In the illustrated embodiment, slide bracket 24 includes slide block 45 having a bearing surface and is configured to move longitudinally and transversely with respect to first rail 19. It is appreciated that slide block 45 can be attached to slide bracket 24 by any conventional means, including, but not limited to bolts 45', adhesives (not shown), or can be an integral component of the slide bracket (not shown). (See FIGS. 6 and 7.) It is also appreciated that any suitable bearing surface can be used in slide bracket 24 to facilitate movement, such as a ball bearing assembly. In fact, it is contemplated that any conventional mechanism that produces lateral movement of deck 21 can be used.

During operation, slide bracket 24 and pivot mount assembly 28 can move laterally in concert between first stops 52 and second stops 53 on rails 19, 20, respectively.

Slide bracket 24 is also configured to move radially with respect to the longitudinal axis of first rail 19. Because deck 21 can move between Trendelenberg and reverse-Trendelenberg tilt positions, slide bracket 24 is configured to compensate for the relative change in distance between rails 19, 20 that result. As FIG. 6 shows, for example, when second end 23 Trendelenberg tilts, the distance between rails 19, 20 increases by distance 5. In the illustrated embodiment, a slide stop 26 is attached to slide bracket 24 to limit radial movement of slide bracket 24 with respect to first rail 19 to prevent detaching from first rail 19. It is appreciated that slide stop 26 can be attached to slide bracket 24 by any conventional means, including, but not limited to, a bolt 27, an adhesive (not shown), or can be an integral component of the slide bracket itself (not shown).

Figure 7:
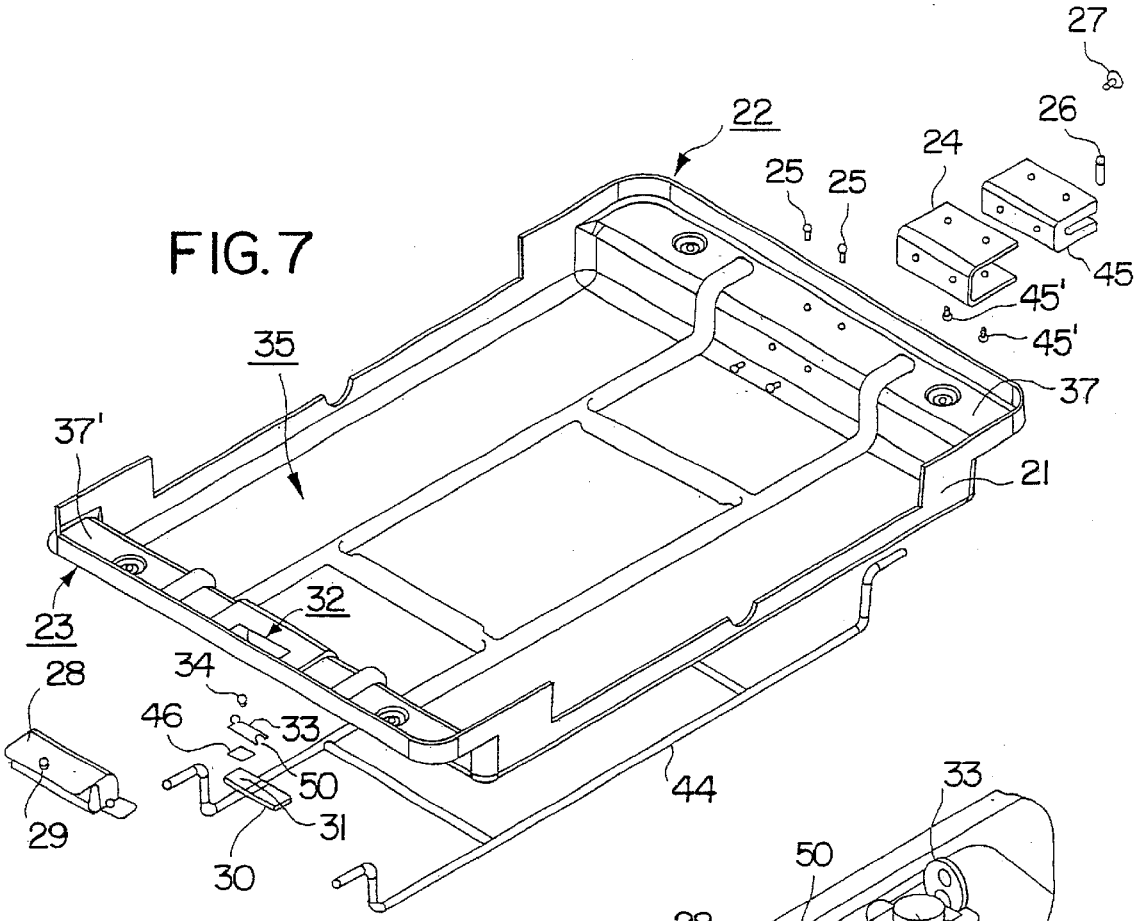
FIG. 7 is another exploded perspective view of a portion of the deck of the patient-support apparatus of FIG. 6.
Figure 8:
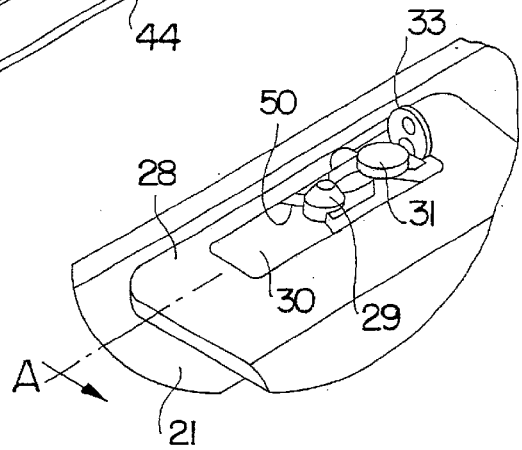
FIG. 8 is a perspective view of a portion of the patient-support apparatus of FIG. 1.
Figure 12:
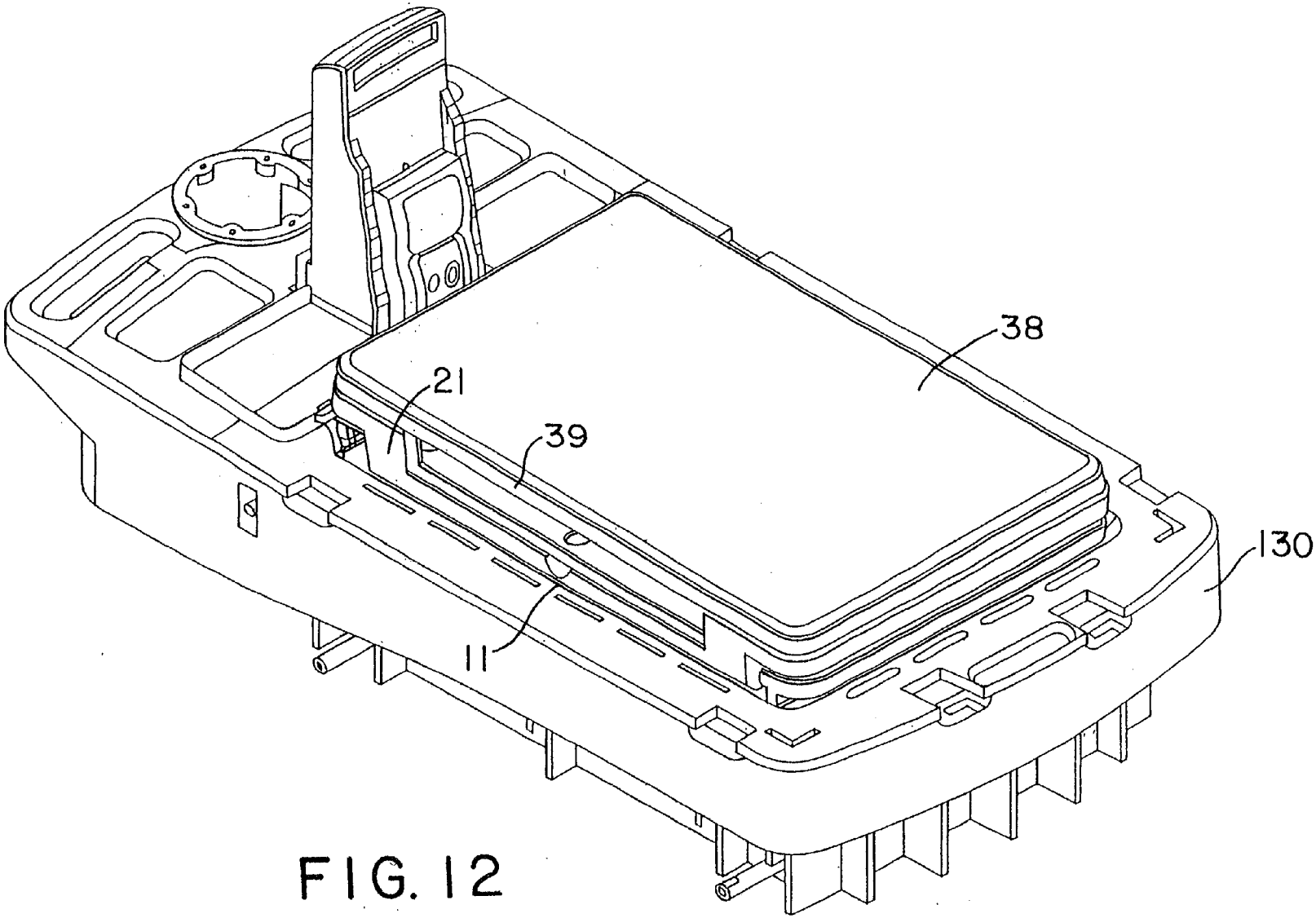
FIG. 12 is still another left-hand perspective view of a portion of the patient-support apparatus of FIG. 1.

Shown in FIG. 7 is an exploded view of a pivot mount assembly 28 that couples with deck 21. Pivot mount assembly 28 is configured to pivot about the longitudinal axis of second rail 20 as the height of mechanisms 15 and/or 16 changes. (See FIGS. 6 and 12.) Pivot mount assembly 28 also includes latch plate 30, guard 46, latch 33, and rivet 34. A latch pin 29 extends from pivot mount assembly 28. Latch plate 30 includes an aperture 31 disposed therethrough sized to receive latch pin 29, and cooperate with opening 32 disposed through second end 23. Latch 33 is configured to slidably secure to latch plate 30 by rivet 34 thereby coupling plate 30 to deck 21. Latch 33 also cooperates with latch pin 29 removably securing pivot mount assembly 28 to second end 23 of deck 21. (See FIGS. 6, 7, 8, and 9.)

Figure 9:
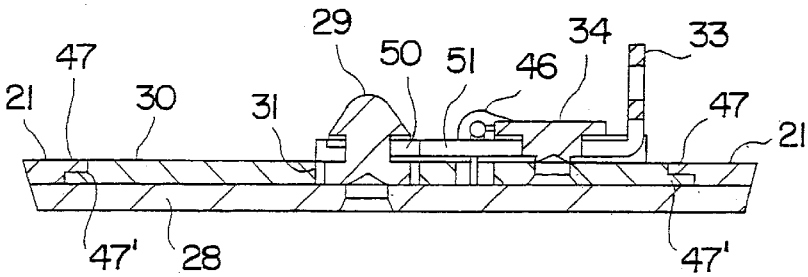
FIG. 9 is a sectional view of a portion of the patient-support apparatus taken along line A—A of FIG. 8.

In the illustrated embodiment, latch plate 30 includes a stepped structure 47, formed about the perimeter of deck aperture 32, that corresponds to a stepped structure 47' formed about the perimeter of latch plate 30, as shown in FIG. 9. Latch pin 29 extends through aperture 31 in latch plate 30 and is secured by latch clamp 50 of latch 33. In addition, rivet 34 travels along rivet opening 51 which is disposed through latch 33 and, in conjunction with guide 46, restricts latch 33 to only linear movement. This allows convenient engagement and disengagement of clamp 50 to latch pin 29. It is appreciated that either pivot mount assembly 28 or slide bracket 24 can be incorporated into or be an integrally formed part of deck 21. In addition, first or second rails 19, 20 can be an integrally formed part of frame 11. It is also appreciated that other structures can be configured to serve the same function as assembly 28 and, thus, replace same.

Figure 13:
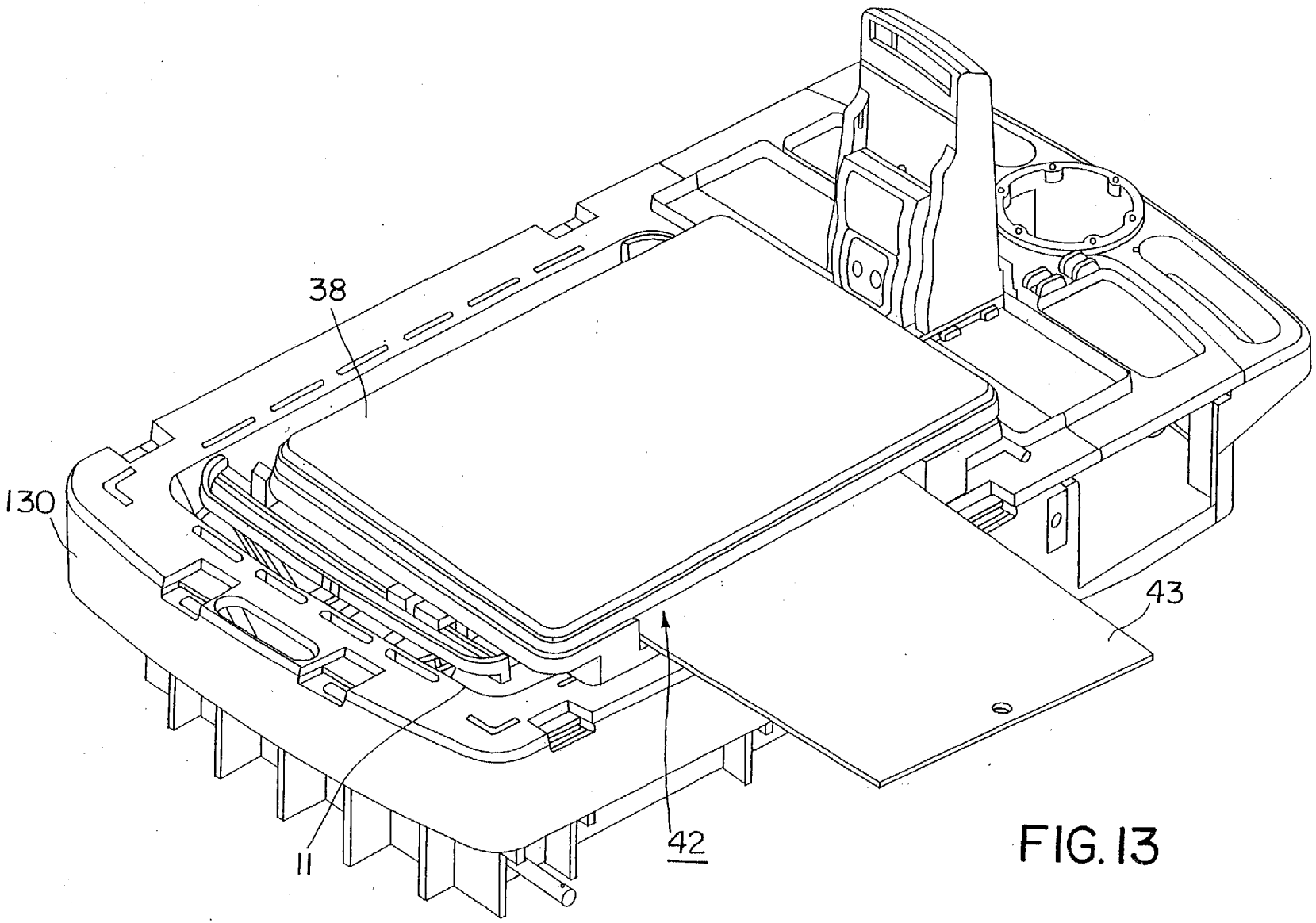
FIG. 13 is a right-hand perspective view of a portion of the patient-support apparatus of FIG. 1.

Recess 35 is formed in deck 21 and sized to accept a scale 36 for weighing an infant. Above recess 35, mattress tray 39 is positioned on top surfaces 37, 37' of deck 21. Mattress tray 39 includes laterally spaced-apart sides 40, 40' to receive mattress pad 38. A slot 42 is provided underneath mattress tray 39 so that an x-ray cassette 43 can be inserted from either side of mattress tray 39. (See FIG. 13.) A weldment 44 is configured to attach to deck 21, as shown in FIG. 7. In the illustrated embodiment, weldment 44 is a rigid frame structure that provides support for the infant lying on the mattress.

Although the foregoing apparatus has been described, one skilled in the art can easily ascertain the essential characteristics of the apparatus, and various changes and modifications may be made to adapt the various uses and characteristics without departing from the spirit and scope of this disclosure, as described by the claims which follow.

What is claimed is:

1. An infant-support apparatus for an incubator or warmer, the apparatus comprising:

a frame; and an infant supporting deck vertically movable between a raised central position and a lowered central position relative to the frame, said deck being tiltable relative to the frame, said deck also being movable relative to the frame to laterally extended positions away from one of the central positions.

2. The apparatus of claim 1, wherein the deck further comprises spaced apart ends.

3. The apparatus of claim 2, wherein the spaced apart ends further comprise first and second ends, wherein the first end includes a first slide assembly and wherein the second end includes a second slide assembly.

4. The apparatus of claim 3, wherein the first and second slide assemblies further comprise first and second sliding surfaces, respectively, and the deck further comprises first and second slide blocks configured to engage the first and second sliding surfaces, respectively, to allow movement of the deck relative to the frame.

5. The apparatus of claim 1, further comprising a weldment attached to the deck.

6. The apparatus of claim 1, wherein the frame includes laterally spaced apart first and second end walls provided adjacent first and second side walls to define a cavity, and wherein the deck substantially occludes the cavity when the deck is in the central position and allows access to the cavity when moved to the laterally extended position.

7. The apparatus of claim 1, further comprising a weight scale coupled to the deck.

8. The apparatus of claim 1, further comprising an x-ray cassette coupled to the deck.

9. An infant-support apparatus for an incubator or warmer, the apparatus comprising:

a frame; and an infant supporting deck having spaced apart first and second ends, the first end including a first slide assembly and the second end including a second slide assembly, the first and second slide assemblies comprising first and second sliding surfaces, respectively, and the deck further comprising first and second slide blocks configured to engage the first and second sliding surfaces, respectively, to permit movement of the deck relative to the frame, the deck having a central position relative to the frame, the deck also being movable relative to the frame to laterally extended positions away from the central position, the first and second slide assemblies being movable in a direction which is not parallel to the lateral movement of the deck.

10. The apparatus of claim 9, wherein the first and second sliding surfaces are rails.

11. The apparatus of claim 9, wherein the first and second slide assemblies are movable between Trendelenberg and reverse-Trendelenberg tilt positions.

12. The apparatus of claim 9, wherein the first slide block is detachable from the deck.

13. The apparatus of claim 12, wherein the second slide block is removably attached to the deck.

14. An infant-support apparatus for an incubator or warmer, the apparatus comprising:

a frame;

an infant supporting deck; and a mounting mechanism configured to position the deck in a central position, to tilt the deck relative to the frame, and to vertically move the deck, as well as to move the deck to laterally extended positions away from the central position.

15. An infant-support apparatus for an incubator or warmer, the apparatus comprising:

a frame; and an infant supporting mattress having a central position relative to the frame, said mattress being tiltable relative to the frame, said mattress also being movable relative to the frame to laterally extended positions away from the central position, and to vertically different positions wherein the mattress is positioned parallel to the central position.

16. An infant-support apparatus comprising a deck configured to support an infant, the deck being movable between a central position, a vertically spaced position, and a position spaced from the central position and in a plane parallel to a plane defined by the deck, wherein the deck does not rotate relative to the frame when moving between the central position and the vertically spaced position.

17. The apparatus of claim 16, wherein the apparatus includes a cavity such that the deck substantially occludes the cavity when the deck is in the central position.

18. The apparatus of claim 17, wherein the deck exposes the cavity when the deck is in the position spaced therefrom.

19. An infant support apparatus comprising:

a frame; and a deck carried by the frame, the deck being mounted to the frame for movement relative to the frame between a first position placing the infant within heating proximity of a heater assembly, a second position laterally spaced apart from the first position, and a third position vertically spaced apart from the first position.

20. The apparatus of claim 19, wherein the deck further comprises spaced apart first and second ends.

21. The apparatus of claim 20, wherein the first end includes a first slide assembly and wherein the second end includes a second slide assembly.

22. The apparatus of claim 21, wherein the first and second slide assemblies further comprise first and second sliding surfaces, respectively, and the deck further comprises first and second slide blocks configured to engage the first and second sliding surfaces, respectively, to allow movement of the deck relative to the frame.

23. The apparatus of claim 22, wherein the first and second sliding surfaces are rails.

24. The apparatus of claim 22, wherein the first and second slide assemblies are movable in a direction non-parallel to the lateral movement of the deck.

25. The apparatus of claim 24, wherein the first and second slide assemblies are movable between Trendelenberg and reverse-Trendelenberg tilt positions.

26. The apparatus of claim 24, wherein the first slide block is detachable from the deck.

27. The apparatus of claim 26, wherein the second slide block is removably attached to the deck.

28. The apparatus of claim 19, further comprising a weldment attached to the deck.

29. The apparatus of claim 19, wherein the frame includes laterally spaced apart first and second end walls provided adjacent first and second side walls to define a cavity, and wherein the deck substantially occludes the cavity when the deck is in the central position and allows access to the cavity when moved to the laterally extended position.

30. The apparatus of claim 19, further comprising a weight scale coupled to the deck.

31. The apparatus of claim 19, further comprising an x-ray cassette coupled to the deck.

* * * * *